United States Patent [19]

Rudolph et al.

[11] Patent Number: 4,829,164

[45] Date of Patent: May 9, 1989

[54] COUNTER

[75] Inventors: Achim J. Rudolph, Glastonbury; Arnold C. Johnson, West Hartford; Paul L. Kennedy, West Haven, all of Conn.

[73] Assignee: Western Pacific Industries Inc., New York, N.Y.

[21] Appl. No.: 220,239

[22] Filed: Jul. 18, 1988

Related U.S. Application Data

[63] Continuation-in-part of Ser. No. 116,487, Nov. 2, 1987, Pat. No. 4,774,398.

[51] Int. Cl.[4] ..... G06C 5/02

[52] U.S. Cl. ..... 235/139 R; 235/1 C; 235/1 D; 235/117 R; 235/130 R

[58] Field of Search ..... 235/1 D, 1 A, 1 C, 117 R, 235/130 R, 139 R, 95 R, 96, 1 R, 139 A

[56] References Cited

U.S. PATENT DOCUMENTS

| | | | |
|---|---|---|---|
| 1,797,738 | 3/1931 | Tittensor . | |
| 1,919,493 | 7/1937 | Zubaty | 235/96 |
| 2,131,622 | 8/1935 | Helgeby . | |
| 2,692,730 | 10/1954 | Wells . | |
| 2,945,624 | 7/1960 | Nicolaus | 235/1 C X |
| 3,092,319 | 6/1963 | Bright . | |
| 3,097,792 | 7/1963 | Harada . | |
| 3,107,855 | 10/1963 | Miner . | |
| 3,137,444 | 6/1964 | Harada . | |
| 3,223,323 | 12/1965 | Lawless et al. . | |
| 3,229,907 | 1/1966 | Shatas et al. | 235/117 R |
| 3,336,768 | 8/1967 | Kleefisch . | |
| 3,337,129 | 8/1967 | Johnson . | |
| 3,380,149 | 4/1968 | Holbrook . | |
| 3,408,003 | 10/1968 | Holbrook . | |
| 3,432,096 | 3/1969 | Powell | 235/96 |
| 3,667,671 | 6/1972 | Hachtel . | |
| 3,770,193 | 11/1973 | Sauter . | |
| 3,801,005 | 4/1974 | Pniewski | 235/95 R |
| 3,981,441 | 9/1976 | Walters . | |
| 4,015,109 | 3/1977 | Deming | 235/96 |
| 4,195,768 | 4/1980 | Herr et al. | 235/95 R X |
| 4,493,988 | 1/1985 | Ichimura | 235/96 |
| 4,499,370 | 2/1985 | Nishiuchi | 235/1 C X |

OTHER PUBLICATIONS

Eliot K. Buckingham "Here's How to Design Full and Semi Recess Action Gears", Jun. 8, 1964, McGraw-Hill Publishing Co.

*Primary Examiner*—B. R. Fuller

*Attorney, Agent, or Firm*—Chilton, Alix & Van Kirk

[57] ABSTRACT

A counter employs a barrel for rotatably mounting high order counter wheels and a shaft integrally extending from the barrel for mounting the lowest order counter wheel. The barrel forms a groove in which the transfer pinion assembly is located. The walls of the groove are engageable by the pinion assembly to limit skewing of the pinion assembly components. The transfer pinions are configured to prevent axial jamming displacement against the counter wheels. The lowest order wheel is snapped onto the shaft and secured in position by means of a semi-flexible mounting hub and cooperative shaft detents. The counter forms an efficient internal light path for illumination of the counter.

15 Claims, 8 Drawing Sheets

COUNTER

CROSS-REFERENCE TO RELATED APPLICATION

This application is a continuation-in-part of U.S. patent application No. 116,487 filed on Nov. 2, 1987, U.S. Pat. No. 4,774,398.

BACKGROUND OF THE INVENTION

This invention relates to counters Which employ rotatable counter wheels. More particularly, the present invention relates to new and improved counters of highly efficient, inexpensive construction.

Counters which employ rotatable wheels having consecutive numerals on the peripheral outer surfaces of the wheels are well known. Such counters typically employ several counting wheels having consecutive numerals on their outer peripheral surfaces and transfer pinions between adjacent wheels for rotatably advancing the count of a succeeding number wheel in response to the rotatable advancement of a lower order wheel.

SUMMARY OF THE INVENTION

Briefly stated, the invention in a preferred form is a non-resettable, low cost counter which may be efficiently constructed from a relatively small number of plastic components. The counter comprises a lowest order counter wheel which is adapted to be rotatably driven and a multiplicity of higher order counter wheels. An axially extending barrel forms a segmental cylindrical surface which receives the counter wheels in axial side-by-side disposition to form a bank of coaxial rotatable wheels of increasing order. The barrel also defines an axially extending groove recessed from the cylindrical mounting surface and an end wall at one axial end of the groove. A pinion shaft integrally extends from the end wall and axially traverses the groove.

Transfer pinions are mounted to the pinion shaft and engage between adjacent counter wheels for rotatably advancing a higher order wheel in response to pre-established angular rotation of the lower order wheel. The transfer pinions each comprise a plurality of teeth having peripheral portions which are engageable against the portions of the barrel that define the groove so as to limit skewing of the pinion assembly to thereby maintain the transfer pinion assembly in a proper operative engagement with the counter wheels. The transfer pinions have a chamfer-like contoured end surface to prevent the pinions for jamming against the inside portions of an adjacent counter wheel so as to present a high level transient in the torque load of the counter.

The higher order counter wheels comprise an integral, radially recessed driven gear and an integral driving gear. The gears are engageable with respective transfer pinions. A wheel mounting shaft integrally extends from the lower order end of the barrel. In one embodiment, the lowest order counter wheel comprises a semi-flexible hub which is rotatably mounted to the mounting shaft. A pair of diametral detents project from the shaft. The lowest order counter wheel has a support panel which defines a pair of diametrically opposed recesses adjacent the hub so as to permit flexure in the hub. The hub may be mounted to the shaft by aligning the recesses and detents and axially forcing the lowest order wheel onto the mounting shaft. The barrel comprises integral stops which interact with the lowest order wheel to define the axial position thereof. A key shaft integrally axially extends from the barrel at an end opposite to the hub mounting shaft. The key shaft at an outer portion may have a square section for keying the barrel to a support frame.

The lowest order wheel in one embodiment further comprises a plurality of axially extending equiangular spaced drive pins. The transfer pinions are recessed action gears which drivably engage driven gears and are engaged by driving gears along a length of contact wherein most of the engagement contact occurs during the recess action interval of the contact length.

The barrel may be manufactured from a transparent or translucent material. The barrel and the counter wheels of the counter may be constructed in a fashion which provides an internal light path to illuminate the counter in an efficient and aesthetically pleasing manner.

An object of the invention is to provide a new and improved counter of efficient and low cost construction.

Another object of the invention is to provide a new and improved counter which may be assembled in an efficient manner that is especially adaptable for automated assembling techniques.

Another object of the invention is to provide a new and improved counter which can be efficiently adapted for operation in conjunction with an external light source for internal illumination in an aesthetically pleasing manner.

A further object of the invention is to provide a new and improved counter of durable construction which operates in an efficient and reliable manner and is constructed of relatively few components.

A yet further object of the invention is to provide a new and improved counter which may be constructed of relatively inexpensively molded components and operates in an efficient manner with relatively low friction and is highly resistant to operational malfunction.

Other objects and advantages of the invention will become apparent from the drawings and the specification.

DETAILED DESCRIPTION OF THE INVENTION

Figure 1:
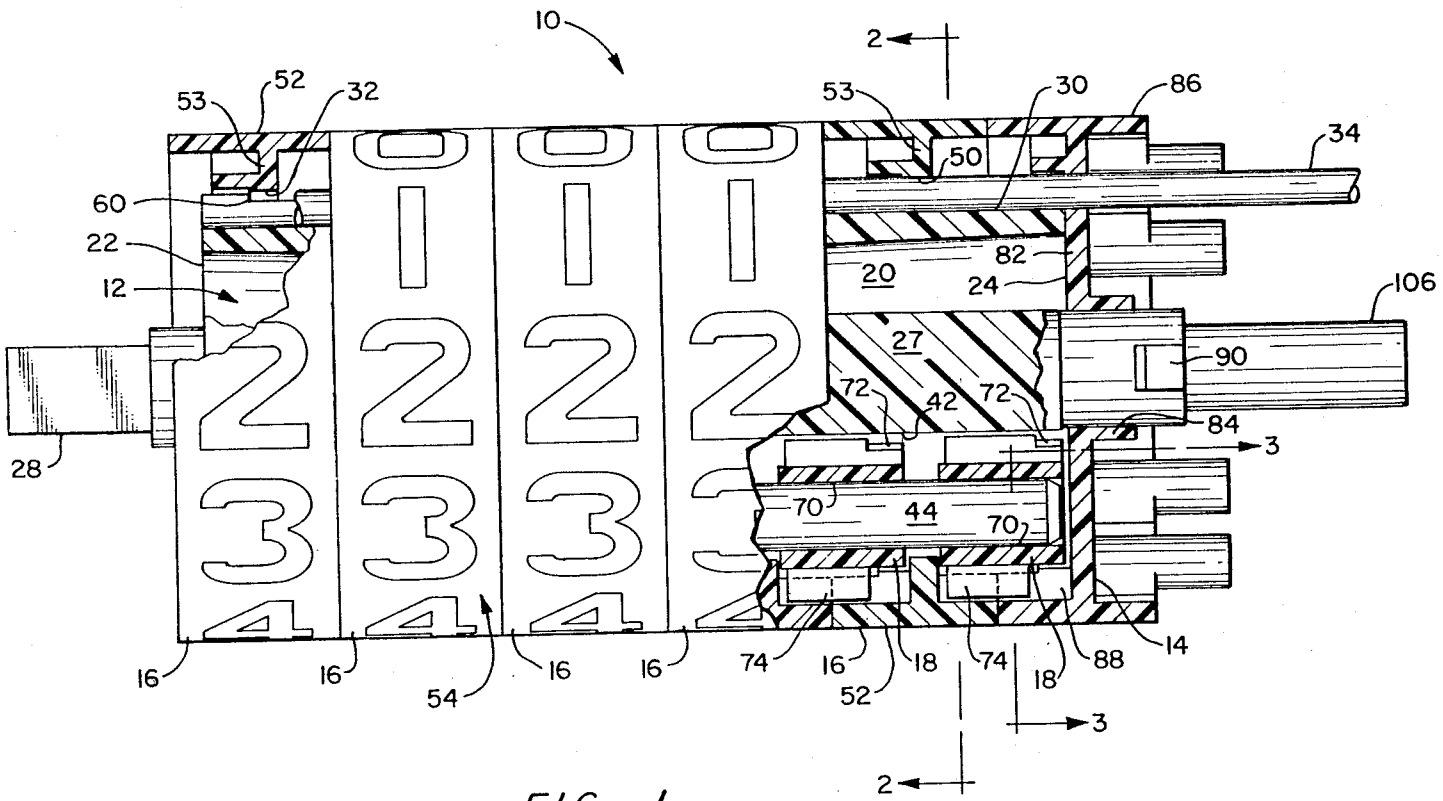
FIG. 1 is a front view, partly broken away and partly in section, of a counter in accordance with the present invention.

With reference to the drawings wherein like numerals represent like parts throughout the several figures, a counter in accordance with the present invention is generally designated by the numeral 10. Counter 10 is a non-resettable type counter having an efficient and inexpensive construction. The counter includes a unitary barrel unit 12 which provides the principal assembly mounting structure for the counter. A lowest order counter wheel 14 and five substantially identical high order wheels 16 are rotatably mounted to the barrel unit to form a bank of counter wheels of ascending order. Five substantially identical transfer pinions 18 which may be manufactured from the same mold are employed for transferring the count from lower order wheels to adjacent higher order wheels. The barrel unit 12, the counter wheels 14 and 16, and the pinions 18 are each molded plastic components. It will be appreciated that the invention is not limited to a specific number of counter wheels nor a specific component material.

Figure 6:
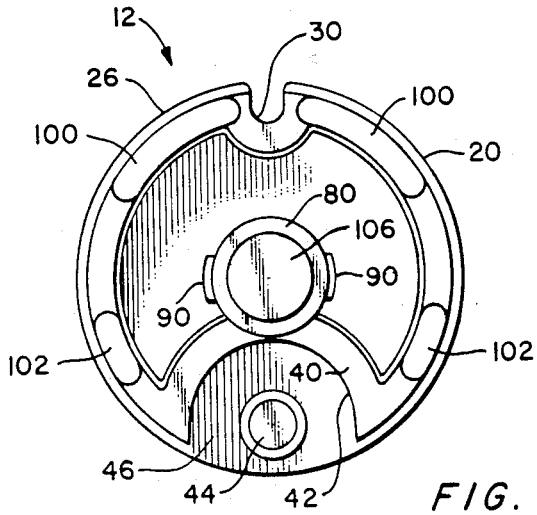
FIG. 6 is an end view of the counter of FIG. 1 viewed from the right thereof with the counter wheels being removed.
Figure 5:
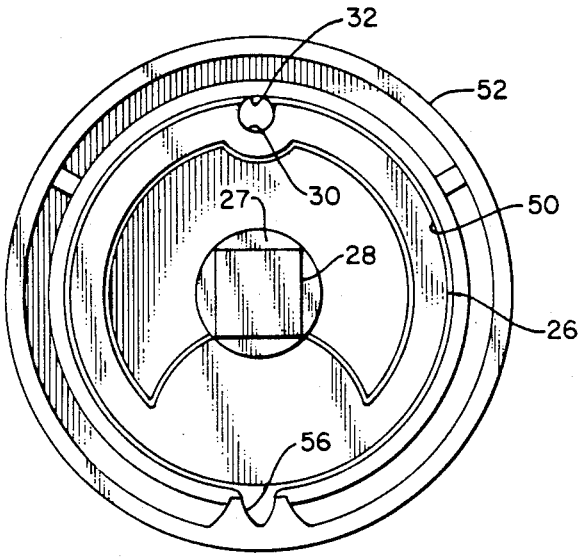
FIG. 5 is an end view of the counter of FIG. 1 viewed from the left thereof.
Figure 7:
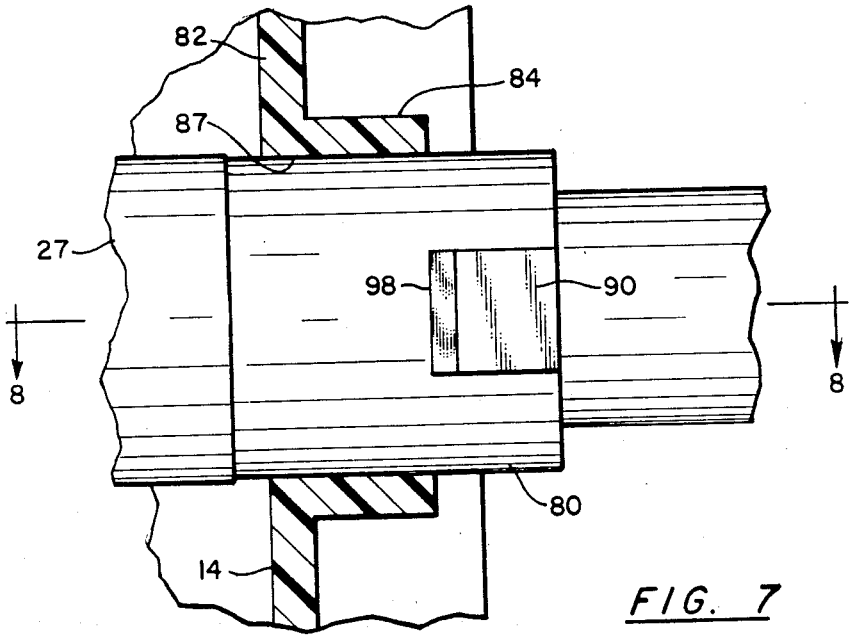
FIG. 7 is an enlarged fragmentary view, partly broken away, of the lowest order counter wheel mounting assembly of the counter of FIG. 1.
Figure 8:
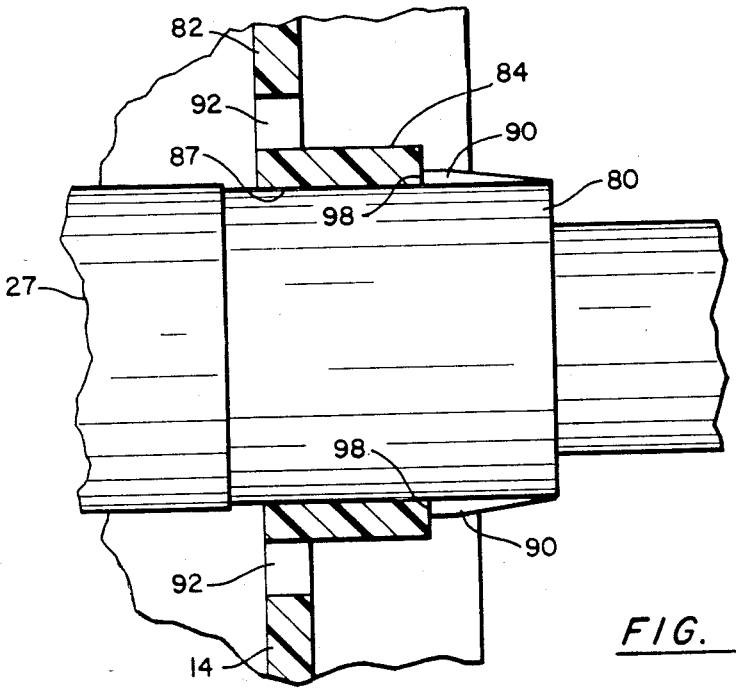
FIG. 8 is a sectional view of the counter assembly of FIG. 7 taken along the line 8—8 thereof.
Figure 9:
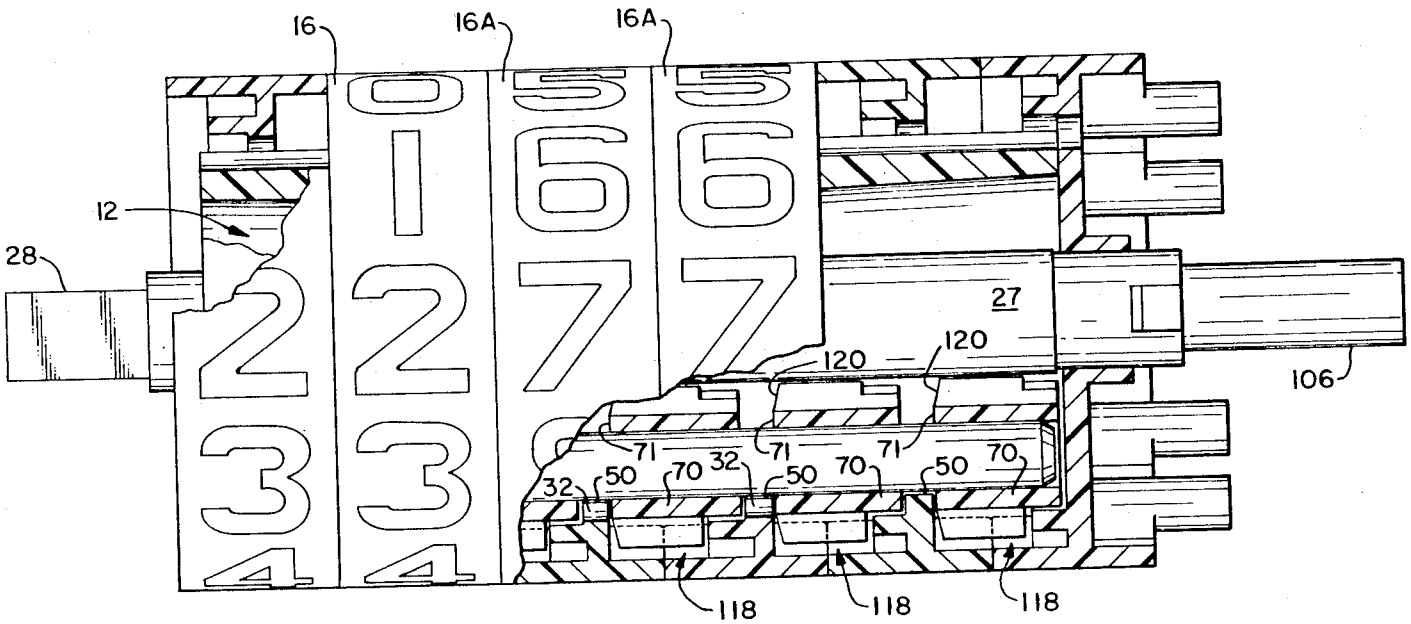
FIG. 9 is a fragmentary front view, partly broken away and partly in section, of an alternate embodiment of a counter in accordance with the present invention.

With reference to FIGS. 1 and 6, the barrel unit 12 comprises a central axially extending barrel 20. Barrel 20 has an exterior segmental cylindrical surface 20 which extends from a higher order end 22 to a lower order end 24. The cylindrical barrel surface functions to rotatably mount the counter wheels 16. The high order wheels 16 are mounted in sequence in descending order by axially sliding the wheels over the barrel surface. A circumferential flange 26 (FIG. 5) at the high order end of the barrel engages the highest order wheel and functions as a reference and retaining stop for the counter wheel assembly.

A central support shaft 27 axially traverses the barrel and connects with the barrel via an intermediate transversely extending support plate (not illustrated). A key shaft 28 projects axially from the support shaft at the high order end of the barrel. The key shaft 28 has a square cross-section (or other suitable configuration) at the terminus so that the shaft may be keyed to a complementary aperture of a support frame (not illustrated) for mounting the barrel unit 12 in a fixed rotational relationship with the frame.

Figure 2:
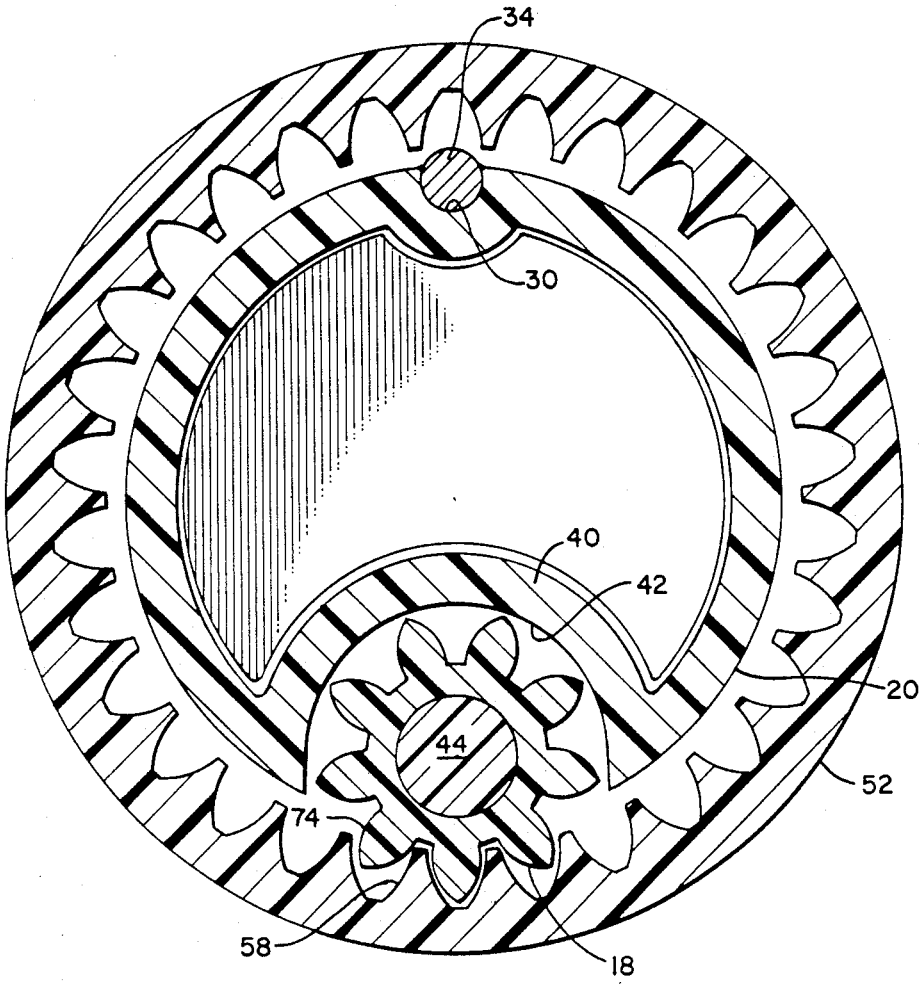
FIG. 2 is an enlarged sectional view taken along the line 2—2 of FIG. 1.

With additional reference to FIG. 2, an axially extending alignment slot 30 traverses the barrel. Each of the counter wheels 16 has an alignment notch or aperture 32 which is angularly alignable with the alignment slot 30. During assembly, the barrel is positioned so that an alignment pin 34 of the assembly fixture extends through the alignment slot 30. The counter wheels 16 are angularly positioned and mounted to the barrel so that the alignment pin 34 extends through the notches of the counter wheels to thereby properly index or angularly align the counter wheels. The alignment pin 34 is removed from the assembled counter to permit operation of the counter.

A generally truncated U-shaped, recessed wall 40 is formed in the barrel at an angular location which is generally diametrically opposite the alignment slot 30 in the illustrated embodiment. Other locations of wall 40 are also possible. The wall 40 defines a trough or groove 42 which axially traverses the barrel from the high order end to the low order end. A pinion shaft 44 integrally extends from an end wall 46 (FIG. 6) at the high order end of the barrel and traverses the axial length of the groove. Pinion shaft 44 slidably mounts the pinions 18 in axial spaced relationship for rotatable engagement between adjacent counter wheels as will be detailed below.

The high order wheels 16 are coaxially aligned in side by side relationship and mounted for rotational movement on the barrel which essentially functions as a diametrically enlarged wheel supporting shaft. Each of the high order counter wheels 16 are substantially identical components which may be manufactured from the same mold. The counter wheels 16 are molded as single units which comprise a narrow inner mounting and bearing rim 50 and an outer peripheral rim 52 having suitable readout indicia 54 such as the consecutive numerals from 0 to 9. An annular support panel 53 integrally connects with rim 52 and extends radially inwardly to define the mounting rim 50. On the high order side of each counter wheel 16 is an integrally formed two tooth driving gear 56 (FIG. 5) which extends radially inwardly from the outer rim 52. The driving gear 56 may be diametrically opposite the alignment notch 32 which is formed in the mounting rim 50. On the low order side of each counter wheel 16 is an integrally formed radially recessed, involuted driven gear 58 having thirty teeth. Naturally, other numbers of teeth are also possible.

The transfer pinions 18 are mounted to the pinion shaft 44 and are engageable between driving gears 56 and driven gears 58 of adjacent counter wheels for transferring the count from a lower order wheel to a higher order wheel. The transfer pinions 18 each have a central sleeve portion 70 which rotatably mounts on the pinion shaft 44. The sleeve portion 70 carries a plurality of alternating full and mutilated teeth 72 and 74, respectively, for providing the appropriate count transfer within the bank of counter wheels. In a preferred embodiment, there are three full teeth 72 and six mutilated teeth 74. The teeth 72 and 74 of the pinions extend radially from the pinion shaft a distance which is slightly less than corresponding distance from the pinion shaft to the groove defining wall 40. The clearance between wall 40 and the pinion teeth in one example ranges from 0.0015 to 0.0055 inches for a counter having a counter wheel diameter of approximately 0.740 inches. It will be appreciated that the pinions are received in the groove 42 and enclosed by the indicia rims 52 of adjacent counter wheels. In normal operation, the pinion teeth do not engage wall 40. However, the outer peripheral portions of the teeth are essentially engageable with the wall 40 to provide a support structure for the transfer pinion sub-assembly in the event that the pinion shaft warps or the pinions are skewed or transversely displaced during operation. Consequently, the wall 40 functions to maintain the pinion assembly in proper operational engagement with the counter wheels. The wall 40 essentially prevents the pinions from disengaging from the gearing of the counter wheels and thus helps to provide a counter which is tamper resistant.

The axial positioning of the pinions is determined by the cooperative engagement of the pinions axially with the integral driving and driven gears of adjacent counter wheels 16 (and counter wheel 14 for the lowest order transfer pinion). The radial or transverse positioning of the transfer pinions is defined by the pinion shaft 44 which may have some flexure characteristics and (if required) the cooperative engagement of the peripheral edges of the pinions 18 with the groove defining wall 40 of the barrel. The wall 40 thus functions as an auxiliary alignment trough to keep the transfer pinions in proper alignment and/or engagement relationship within the bank of counter wheels without the necessity of incorporating partition plates between the counter wheels.

In one embodiment of the invention, pinion shaft 44 is not employed. The axial positioning of the pinions 18 is determined by the cooperative engagement of the pinions with the integral driving and driven gears of adjacent counter wheels. The transverse positioning of the transfer pinion 18 is principally determined by the cooperative engagement of the peripheral edges of the pinions with the groove defining wall 40 of the barrel. The wall 40 and counter wheels thus function to compartmentalize the pinions in proper operative relationship within the barrel assembly.

The counter wheels 16 and the pinions 18 are mounted to the barrel unit 12 in alternating fashion. The highest order counter wheel 16 is axially slidably received by the barrel until the high order edge 60 of the mounting rim 50 engages flange 26. The assembly is accomplished with the notch 3 being engageably aligned with the alignment pin 34 which is maintained in place (as illustrated in FIG. 1) throughout the assembly process. A transfer pinion 18 is then mounted to the pinion shaft 44 and axially moved therealong until the high order end of the pinion teeth 72 and 74 engage the driven gear 58 of the counter wheel. The next highest order counter wheel is then slidably mounted to the barrel, suitably aligned by means of the alignment pin and axially displaced until the pinion teeth 72 of the highest order pinion engage the driving gear 56 of the next highest order counter wheel. The assembly process is essentially replicated for each of the high order counter wheels and transfer pinions with the axially alternating pinions being successively entirely enclosed by the outer indicia rims 52 of the respective counter wheels.

With reference to FIGS. 9 through 12, an alternate embodiment of a transfer pinion 118 may be employed in place of the previously described transfer pinion 18. Because the components of the described counter 10 are preferably molded from plastic, it may not be possible to manufacture components within tolerances which allow for a uniform torque load of the counter throughout the entire operational life or cycle thereof under all conditions. Manufacturing variances in the transfer pinions 18 may under certain extreme operative conditions result in momentary counter jamming and thus counter torque load increases.

The high order end 71 of the transfer pinion sleeve may momentarily axially ride under the inside mounting rim 50 of an adjacent counter wheel under a wide variety of conditions. The latter described phenomenon is more likely to occur when the alignment aperture 32 of a counter wheel closely approaches the sleeve 7 of the adjacent transfer pinion (as illustrated by counter wheels 16A in FIG. 9) or when the counter is oriented at a angle to the horizontal plane. When the end 71 of the sleeve rides under the mounting rim, a momentary jamming condition and increase in the torque load of the counter may result. While in practice under most conditions and for the vast majority of manufacturing and assembly tolerances, the counter 10 as previously described operates in a highly reliable manner, transfer pinion 118 is particularly adapted to prevent the foregoing described jamming of the transfer pinion with the mounting rim 50 of the counter wheel. The use of transfer pinions 118 thus essentially allows for a greater tolerance range for the molded components and provides greater counter reliability.

Figure 10:
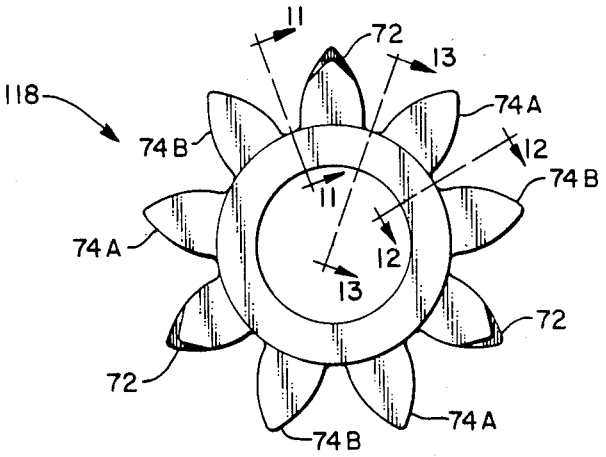
FIG. 10 is an enlarged interior end view of a transfer pinion of FIG. 9 viewed from the right thereof.
Figure 11:
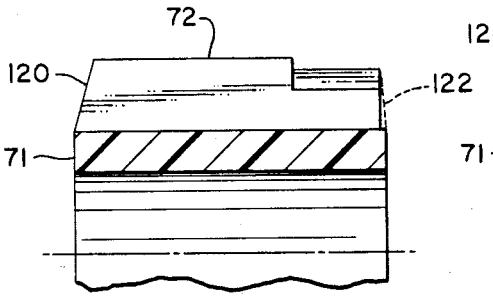
FIG. 11 is an enlarged fragmentary sectional view of the transfer of FIG. 10 taken along the line 11—11 thereof.
Figure 12:
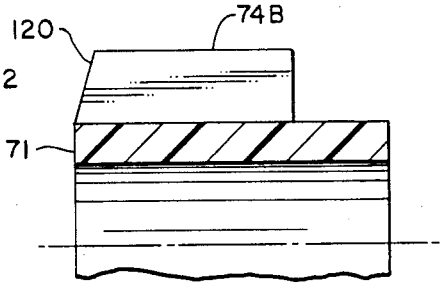
FIG. 12 is an enlarged fragmentary sectional view of the transfer of FIG. 10 taken along the line 12—12 thereof.
Figure 13:
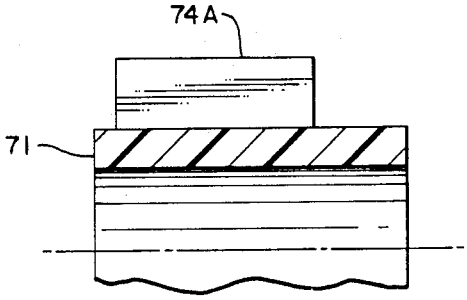
FIG. 13 ia an enlarged fragmentary sectional view of the transfer pinion of FIG. 10 taken along the line 13—13 thereof.

The high order end of transfer pinion 118 is defined by a generally conically-shaped chamfer surface 120. The chamfer surface 120 extends in a tapered fashion from the outer radial periphery of selected teeth 74 and 72 of the transfer pinion to the axial terminus or high order end 71 of the pinion sleeve 70. As best illustrated in FIG. 10, the chamfer surface 120 integrally defines the high order end of all three of full teeth 72 as well as three of the mutilated teeth 74A. By incorporating the chamfer surface 120 relative to six of the nine gear teeth, a portion of the chamfer surface 120 will always contact the radial edge adjacent to the mounting rim 50 to prevent jamming or riding of the transfer pinion under the mounting rim regardless of the rotational or angular position of a given counter wheel. A chamfer surface 122 (illustrated by broken lines) may also be formed at the opposing (low order) end of the transfer pinion 118. Chamfer surface 122 is ordinarily not as important as chamfer surface 120 at the higher order end of the pinion with respect to inhibiting the transfer pinion wheel from jamming an adjacent counter wheel.

The chamfer surface 120 preferably defines the end of three, six or nine pinion teeth at the high order end thereof. In the disclosed pinion 118, there are mold gate constraints which do not allow the chamfer surface 120 to extend at the end of each tooth 74B. The chamfer surface 122 only extends between the low order sleeve end and full teeth 72. The conical taper of the chamfer surfaces essentially function so that the engagement of the high order end of the pinions (and where applicable, the low order end) against the counter wheel inside mounting rims function to walk or urge the pinions away from a jamming engagement with the mounting rims.

With additional reference to FIGS. 4, 6, 7 and 8, a wheel mounting shaft 80 integrally axially extends from the central support shaft 27 at the low order end of the barrel. Shaft 80 functions to rotatably mount the lowest order wheel 14. Wheel 14 includes a central medial panel 82 which radially extends between a mounting hub 84 and the outer indicia rim 86. The hub 84 has a resilient semi-flexible construction. The hub 84 defines an axial mounting aperture 87 which is substantially commensurate in diameter with the corresponding diameter of the shaft 80. A two tooth driving gear 88 (FIG. 1) extends radially inwardly from the indicia rim 86 at the high order side of the counter wheel 14.

Figure 4:
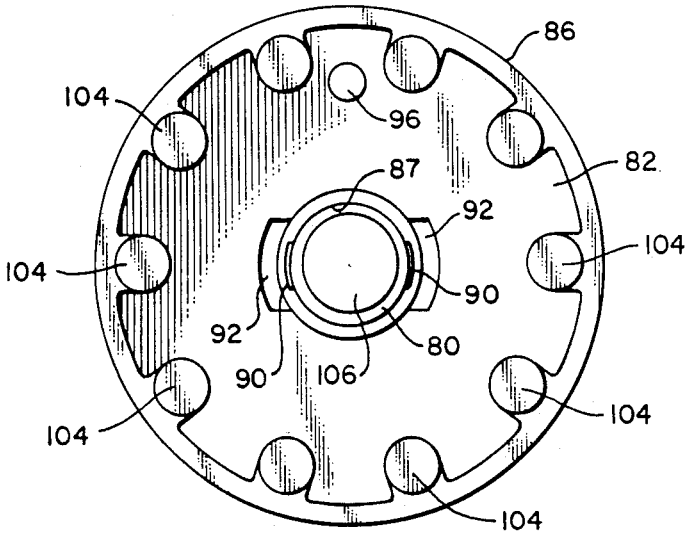
FIG. 4 is an end view of the counter of FIG. 1 viewed from the right thereof.

A pair of diametrically opposed, radial projections or detents 90 project from shaft 80. The detents 90 are ramp or cam-like structures which have transversely extending detaining edges 98 and are tapered so as to converge toward the outer end of the mounting shaft 80. A pair of diametrically opposed arcuate recesses 92 are formed in the panel 82 adjacent the hub 84. As best illustrated in FIG. 4, the angular extent of the recesses 92 exceeds the corresponding angular extent of the detents 90 to allow opposed portions of the hub to flex or deform outwardly. Upon angularly aligning the recesses with the detents and axially forcing the lowest order wheel 14 onto the mounting shaft 80, the hub 84 flexes sufficiently to ride over the detents 90. Upon the hub axially passing beyond the detent detaining edges 98 (to the left), the hub assumes its normal non-flexed state. The hub may be described as snapping into position against the detents to axially secure the lowest order counter wheel 14 to the barrel sub-assembly 12. The panel 82 also defines an alignment opening 96 for maintaining the proper indexing of the counter wheel during the assembly process. Once mounted, the lowest order counter wheel can not be easily dismounted from the barrel assembly. Thus, the assembled counter is highly resistant to tampering.

The axial position of the lowest order counter wheel 14 is automatically defined by the detaining edges 98 of the detents 90 and arcuate segmented edges 100, 102 of the lower order end of the barrel. The segmented edges 100, 102 function as a stop which engages the surface of the panel 82 to limit the axial movement of the lowest order counter wheel toward the high order end of the counter. It will be appreciated that the lowest order wheel 14 is essentially snapped into place in a single assembly step which automatically fixes both the correct angular position and the correct axial position of the lowest order wheel. No additional end play adjustment of the counter wheels is required.

With additional reference to FIG. 4, a plurality of equiangularly spaced drive pins 104 axially integrally project from the lowest order wheel 14. The lowest order wheel 14 functions as the drive wheel for the bank of the counter wheels. The drive pins are adapted for engagement with a drive gear (not illustrated) for driving the counter. The drive gear may be mounted to reduced shaft extension 106 axially extending from shaft 80. It should be appreciated that the key shaft 28 essentially fixes the angular relationship of the barrel with the principal mounting frame so that the counter wheels are rotatable about the barrel in response to a rotational drive applied to the lowest order counter wheel 14. Any axial load that may be applied to the counter at the lowest order counter wheel 14 is not transferred to the higher order wheels 16 and does not effect the end play of the counter wheels.

Figure 3:
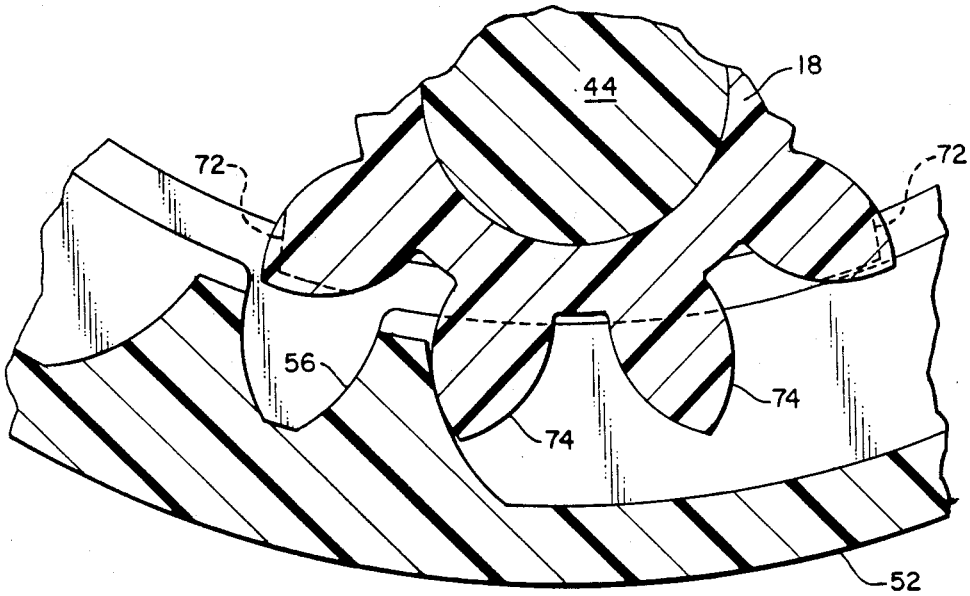
FIG. 3 is an enlarged fragmentary sectional view taken along the line 3—3 of FIG. 1.

In order that the frictional engagement between the transfer pinions and the driving and driven gears of the counter wheels be reduced, the gearing system of the counter is a full recess gear system as best illustrated in FIG. 3 or a semi-recess gear system rather than a standard involute gear system. In a standard involute gear system, the approach action exceeds the recess action interval along the length of contact of the gears. By incorporating a recess gear system, the majority of the engagement contact between the pinion 18 and the driving gear 56 as well as the contact between the pinion 18 and the driven gear 58 occurs during the recess portion or recess action interval of the length of contact between the gears and pinion. The application is particularly advantageous in counters such as disclosed. The friction during the recess action of gear engagement is on the order of half that during the approach action. The recess action is essentially a sliding out type action wherein the friction is lower and in a direction which aids the rotation. Consequently, the surface endurance limits of the molded gear structures and load capacity of the engaging pinion/counter wheel gears is enhanced.

Because the counter 10 does not require partition plates between the counter wheels, the counter wheels may have a wider construction and an enhanced contact area between the pinion teeth and the counter wheel is provided. The wall 40 forms a trough which ensures that the pinions do not skew so as to result in an operational malfunction of the counter. The described counter is constructed from only four different components, e.g. a barrel unit 12, a lowest order counter wheel 14, high order counter wheels 16 and transfer pinions 18.

Figure 14:
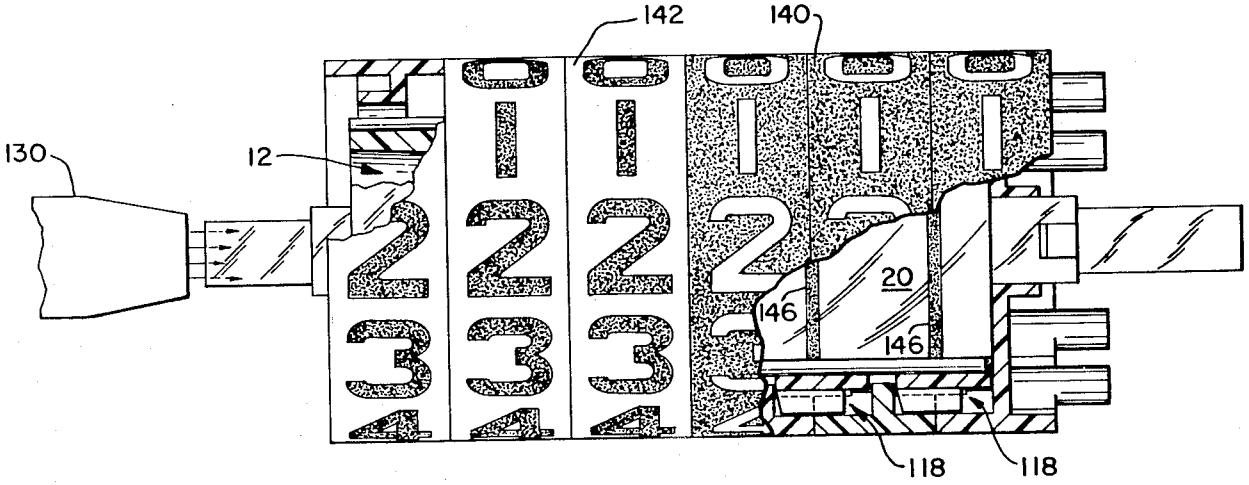
FIG. 14 is a front view, partly broken away, partly in section and partly in schematic, illustrating an illuminated counter embodiment in accordance with the present invention.

The features of the uninterrupted integral one-piece nature of the barrel unit 12 and the relatively thin wall of the counter wheel rims may be employed to provide an internal light path and allow for the assembled counter to be relatively easily and efficiently internally illuminated as best illustrated in FIG. 14. The internal illumination yields a highly pleasing aesthetic appearance to the counter. The illuminated counter of FIG. 14 has specific applicability as a vehicular odometer. Preferably, the barrel unit 12 is formed from a polycarbonate material, clear plastic material or other transparent or semi-transparent material. A light source schematically designated at 130 may be externally applied at an end portion of the barrel assembly. The external light source may be applied at either the low order end or high order end of the barrel assembly, as well as at the other barrel assembly locations. The integral barrel assembly defines a light path which conducts light generally axially throughout the barrel. The light traverses the barrel assembly in a relatively unobstructed manner due to the uninterrupted nature of the barrel unit and the absence of spacer plates and transversely extending obstructions. The light is concurrently radially distributed to pass through the counter wheels to illuminate or highlight the counter numerals.

The counter wheels may have a darkened or opaque-like background and transparent or translucent numerals such as depicted wheel 140 or the numerals may be darkened or be defined with an opaque-like material with the remainder of the counting rim having a transparent or translucent background such as depicted wheel 142. The aesthetic appearance of the illuminated counter may be enhanced for some applications by circumferentially extending opaque or darkened rings 146. The rings 146 are applied or fixed to the clear plastic barrel unit and are axially spaced so as to generally align axially with the spacing between adjacent counter wheels. The darkened material may be applied by hot stamping or other manufacturing processes.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed:

1. A counter comprising:

a lowest order counter wheel adapted to be rotatably driven;

a plurality of high order counter wheels;

barrel means comprising an axially extending barrel for receiving said wheels to form a bank of coaxial rotatable counter wheels of increasing order, said barrel defining an axially extending groove; and transfer means comprising a plurality of transfer pinions mounted in said groove for rotatably advancing a higher order wheel in response to a pre-established angular rotation of a lower order wheel, said transfer pinions each comprising a hub sleeve and a plurality of radially projecting teeth having peripheral portions which are engageable against groove defining portions of said barrel to maintain said transfer means in proper operative position, at least one of said transfer pinions having a chamfer-like contoured surface defined at a high order end of said pinion and substantially extending from the sleeve to define a high order end portion of a plurality of said teeth.

2. The counter of claim 1 wherein said at least one transfer pinion comprises a contoured surface which defines the high order end of three teeth.

3. The counter of claim 1 wherein said at least one transfer pinion comprises a contoured surface which defines the high order end of six teeth.

4. The counter of claim 1 wherein said counter wheels have a rim mounting portion for mounting on said barrel, said contoured surface generally axially engagable against said rim mounting portion to prevent said pinion sleeve from jamming against said rim mounting portion.

5. The counter of claim 1 wherein said at least one of said transfer pinions comprises a second chamfer-like contoured surface extending from the sleeve to define a low order end of a plurality of teeth.

6. A counter comprising:

a lowest order counter wheel adapted to be rotatably driven;

a plurality of high order counter wheels, said counter wheels being affixed with indicia and being formed of a material which permits the passage of light therethrough so as to highlight said indicia;

barrel means comprising an axially extending barrel for receiving said wheels to form a bank of coaxial rotatable counter wheels of increasing order, said barrel defining an axially extending groove and being formed from a material which permits passage of light; and transfer means comprising a plurality of transfer pinions mounted in said groove for rotatably advancing a higher order wheel in response to a pre-established angular rotation of a lower order wheel, said transfer pinions each comprising a plurality of teeth having peripheral portions which are engageable against groove defining portions of said barrel to maintain said transfer means in proper operative position, said counter wheels and said barrel means defining a light path so that a light source applied at one axial end of the barrel means causes light to traverse generally axially through the barrel and generally outwardly through the counter wheels to illuminate the counter.

7. The counter of claim 6 wherein the barrel means is a molded integral member formed of clear plastic material.

8. The counter of claim 6 further comprising rings of generally opaque-like material affixed to said barrel at axially spaced positions which generally align with axial edges of adjacent counter wheels.

9. The counter of claim 6 wherein at least one of said counter wheels defines a peripheral rim affixed with indicia, the indicia comprising a generally opaque-like material which generally obstructs the passage of light and the rim generally permitting the passage of at least some light to highlight said indicia.

10. The counter of claim 6 wherein at least one of said counter wheels defines a peripheral rim affixed with indicia, the indicia defining portions of said rim generally permitting the passage of at least some light and other portions of said rim comprising a generally opaque-like material which generally obstructs the passage of light to highlight said indicia.

11. A counter comprising:

a lowest order counter wheel adapted to be rotatably driven;

a plurality of high order counter wheels, said counter wheels being affixed with indicia and being formed of a material which permits passage of light therethrough so as to highlight said indicia;

barrel means comprising an axially extending barrel for receiving said wheels to form a bank of coaxial rotatable counter wheels of increasing order, said barrel defining an axially extending groove and being formed from a material which permits passage of light; and transfer means comprising a plurality of transfer pinions mounted in said groove for rotatably advancing a higher order wheel in response to a pre-established angular rotation of a lower order wheel, said transfer pinions each comprising a plurality of teeth having peripheral portions which are engageable against groove defining portions of said barrel to maintain said transfer means in proper operative position, said counter wheels and said barrel means defining a light path so that a light source applied to the barrel means causes light to traverse generally throughout the barrel and generally outwardly through the counter wheels to illuminate the counter.

12. The counter of claim 11 wherein the barrel means is a molded integral member formed of clear plastic material.

13. The counter of claim 11 further comprising rings of generally opaque-like material affixed to said barrel at axially spaced positions which generally align with axial edges of adjacent counter wheels.

14. The counter of claim 11 wherein at least one of said counter wheels defines a peripheral rim affixed with indicia, the indicia comprising a generally opaque-like material which generally obstructs the passage of light and the rim generally permitting the passage of at least some light to highlight said indicia.

15. The counter of claim 11 wherein at least one of said counter wheels defines a peripheral rim affixed with indicia, the indicia defining portions of said rim generally permitting the passage of at least some light and other portions of said rim comprising a generally opaque-like material which generally obstructs the passage of light to highlight said indicia.

* * * * *